US006495959B1

(12) United States Patent
Ikeuchi et al.

(10) Patent No.: US 6,495,959 B1
(45) Date of Patent: Dec. 17, 2002

(54) CERMET FOR LAMP AND CERAMIC DISCHARGE LAMP

(75) Inventors: Mituru Ikeuchi, Himeji (JP); Yukiharu Tagawa, Himeji (JP); Masaki Yoshioka, Himeji (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/403,788

(22) PCT Filed: Mar. 3, 1999

(86) PCT No.: PCT/JP99/01002

§ 371 (c)(1),
(2), (4) Date: Jan. 7, 2000

(87) PCT Pub. No.: WO99/46801

PCT Pub. Date: Sep. 16, 1999

(30) Foreign Application Priority Data

Mar. 9, 1998 (JP) ..... 10-057054
Jan. 6, 1999 (JP) ..... 11-000886

(51) Int. Cl.[7] ..... H01J 17/18

(52) U.S. Cl. ..... 313/623; 313/252; 313/283; 156/89.15; 428/331

(58) Field of Search ..... 313/623, 624, 313/625, 252, 262, 274, 283; 428/206, 207, 210, 325, 329, 330, 331, 698, 699, 701, 702; 156/89.15, 272.2, 379.6

(56) References Cited

U.S. PATENT DOCUMENTS 4,334,628 A 6/1982 Buhrer et al.
4,763,828 A * 8/1988 Fukaya et al. ..... 228/124

FOREIGN PATENT DOCUMENTS

| | | |
|---|---|---|
| JP | 57-111944 | 7/1982 |
| JP | 58-75755 | 5/1983 |
| JP | 59-97571 | 6/1984 |
| JP | 61-220265 | 9/1986 |

* cited by examiner

*Primary Examiner*—Vip Patel
*Assistant Examiner*—Joseph Williams
(74) *Attorney, Agent, or Firm*—Nixon Peabody LLP; David S. Safran

(57) ABSTRACT

An improved cermet for hermetically sealing a discharge vessel in a ceramic discharge lamp where the cermet includes a material having a coefficient of linear expansion which is at least equal to a coefficient of linear expansion of a translucent ceramic, and a material having a coefficient of linear expansion which is smaller than the coefficient of linear expansion of the translucent ceramic, where the cermet has an average coefficient of linear expansion in a range of $E \pm 1.0 \times 10^{-6}$ ($K^{-1}$) at a temperature range of 25 to 300° C., where E ($K^{-1}$) is an average coefficient of linear expansion of said translucent ceramic at a temperature range of 25 to 300° C. In addition, a ceramic discharge lamp utilizing such a cermet.

7 Claims, 2 Drawing Sheets

| | Structure of the cermet | Elect. resistance ohms | Aver.coef. of linear exp. [x $10^{-6}$/°C] |
|---|---|---|---|
| Production example 1 | $Al_2O_3$-Mo-Pt | < 1 | 6.3 |
| Production example 2 | $Al_2O_3$-Mo-$Dy_2O_3$ | < 1 | 6.0 |
| Production example 3 | $Al_2O_3$-Mo-$Y_2O_3$ | < 1 | 6.5 |
| Production example 4 | MgO-Mo | < 1 | 6.5 |
| Production example 5 | $ZrO_2$-Mo | < 1 | 6.5 |
| Comparison Production example | $Al_2O_3$-Mo | < 1 | 5.5 |

Fig. 4

CERMET FOR LAMP AND CERAMIC DISCHARGE LAMP

BACKGROUND OF THE INVENTION

1. Field of the Invention

The invention relates to a cermet for a lamp which is used for hermetically sealing a discharge vessel in a ceramic discharge lamp, and also to a ceramic discharge lamp. The invention relates especially to a cermet for a lamp with a coefficient of linear expansion which is essentially equal to the coefficient of linear expansion of a translucent ceramic which forms the discharge vessel, and to a discharge vessel of ceramic with hermetically sealed components such a cermet for a lamp.

2. Description of the Related Art

Conventionally a ceramic discharge lamp which is shown in FIG. 1 (for example patent publication JP-SHO 61-220265) is known which has a discharge vessel 3 of translucent ceramic, with an arc tube part 1 and side tube parts 2 which are joined to the arc tube part 1. In the arc tube part 1, there are a pair of electrodes 4 opposite one another. The electrodes 4 are located in 5 the tip areas of the upholding parts 5 of the electrodes. The base parts of the upholding parts of the electrodes are inserted into hermetically sealed components 6. A hermetically sealed arrangement is obtained by fritting-welding of these hermetically sealed components 6 in the side tube parts 2. In FIG. 1, reference number 7 labels an outer lead which is inserted into the hermetically sealed component 6.

The hermetically sealed component 6 in this discharge lamp consists of a conductive cermet which is obtained by sintering of ceramic powder and metal powder and is hermetically welded by a glass frit (not shown in the drawing) in the side tube part 2.

The ceramic for obtaining this cermet is the same material as the translucent ceramic comprising the discharge vessel 3, for example polycrystalline aluminum oxide, so that the difference between the coefficient of linear expansion of the hermetically sealed component 6 of this cermet and the coefficient of linear expansion of the discharge vessel 3 is reduced.

Molybdenum or tungsten is used as the metal powder to obtain the cermet. To ensure the conductivity necessary for supply, a metal with a percentage by volume from 30 to 60% is contained therein.

Metals such as molybdenum and tungsten which are contained in the cermet have a smaller coefficient of linear expansion than a ceramic like aluminum oxide. The coefficient of linear expansion of the cermet which comprises the hermetically sealed component 6 is therefore, less than the coefficient of linear expansion of the ceramic which comprises the cermet. As a result, between the coefficient of linear expansion of the cermet to be obtained and the coefficient of linear expansion of the translucent ceramic comprising the discharge vessel 3, a difference of greater than $1\times10^{-6}$ ($K^{-1}$) results, even when the same material as that of the translucent ceramic comprising the discharge vessel 3 is used as the ceramic for the cermet.

As a result, the following disadvantages arose when the hermetically sealed components are formed for example from a conventionally known conductive cermet (especially based on aluminum oxide-molybdenum) and from fritting-welding these hermetically sealed components on the discharge vessel of translucent aluminum oxide ceramic.

In welding (cooling process) or at the start of operation (within a few hundred hours), there are cases in which due to the different coefficients of linear expansion of the two material components, cracks form at the welded sites. Reliability is therefore low.

SUMMARY OF THE INVENTION

The first object of the invention is to devise a cermet for a lamp in which the reliability of the hermetically sealed parts is increased by the fact that their coefficient of linear expansion is made essentially equal to the coefficient of linear expansion of a translucent ceramic which comprises the discharge vessel of a discharge lamp of ceramic.

A second object of the invention is to devise a cermet for a lamp in which no cracks form at the weld spots, even if it is frit-welded as the hermetically sealed components of a discharge lamp of ceramic in the side tube parts of the discharge vessel.

The third object of the invention is to devise a ceramic discharge lamp in which no cracks occur at the locations at which side tube parts of the discharge vessel and the hermetically sealed components are frit-welded to one another.

The objects are achieved by a cermet in accordance with the embodiments of the present invention where.

(1) In a cermet for a lamp which is used for hermetically sealing a discharge vessel (10) in a ceramic discharge lamp, the object is achieved in that the cermet contains a material with a coefficient of linear expansion which is greater than or equal to that of a translucent ceramic comprising the discharge vessel (10) of the above described ceramic discharge lamp. Furthermore, the cermet contains a material with a coefficient of linear expansion which is smaller than that of the translucent ceramic, and that the average coefficient of linear expansion at 25 to 300° C. is in the range of $E\pm1.0\times10^{-6}$ ($K^{-1}$) where E ($K^{-1}$) the average coefficient of linear expansion of the translucent ceramic comprising the discharge vessel (10) of the above described ceramic discharge lamp at 25 to 300° C.

(2) In a cermet for a lamp which is used for hermetically sealing a discharge vessel (10) in a ceramic discharge lamp, the cermet is obtained by sintering with one another a ceramic with a coefficient of linear expansion greater than that of a translucent ceramic comprising the discharge vessel (10) of the above described ceramic discharge vessel, and a metal with a coefficient of linear expansion less than that of the translucent ceramic.

(3) In a cermet for a lamp which is used for hermetically sealing a discharge vessel (10) in a ceramic discharge lamp, the object is achieved in that the cermet is obtained by sintering with one another a ceramic, a metal with a coefficient of linear expansion which is less than that of a translucent ceramic comprising the discharge vessel (10) of the above described ceramic discharge lamp, and a material with a coefficient of linear expansion greater than that of the translucent ceramic.

In this cermet for a lamp it is desirable for the average coefficient of linear expansion of the ceramic which forms the cermet at 25 to 300° C. to be in the range of $E\pm1.0\times10^{-6}$ ($K^{-1}$) where E ($K^{-1}$) the average coefficient of linear expansion of the translucent ceramic comprising the discharge vessel (10) of the above described ceramic discharge lamp at 25 to 300° C. It is especially preferred that the ceramic which forms the cermet comprises of the same material as the translucent ceramic comprising the discharge vessel (10) of the above described ceramic discharge lamp.

Furthermore the objects in the ceramic discharge lamp in accordance with the embodiments of the present invention achieved as follows:

(4) In a ceramic discharge lamp including a discharge vessel (10) of translucent ceramic with an arc tube part (11) and side tube parts (12) which are connected to the arc tube part (11), further including a pair of electrodes (21) opposite one another in the arc tube part (11) and in which a hermetically sealed arrangement is obtained by fritting-welding of these hermetically sealed components (24) on the side tube parts (12). The base parts of the upholding parts (22) of the electrodes are inserted, into the hermetically sealed arrangement the upholding parts having trip areas which are provided with electrodes (21) the object is achieved as claimed in the invention in that the above described hermetically sealed components (24) consist of the above described cermet for a lamp.

(5) In a ceramic discharge lamp including a discharge vessel (10) of translucent ceramic with an arc tube part (11) and side tube parts (12) that are connected to the arc tube part (11), further including a pair of electrodes (21) opposite one another in the arc tube part (11) and in which a hermetically sealed arrangement is obtained by fitting-welding of cylindrical or disk-shaped hermetically sealed components (24) on the outside faces of the side tube parts (12). The base parts of the upholding parts (22) of the electrodes are inserted into the hermetically sealed arrangement the upholding parts having tip areas which are provided with electrodes (21) the object is achieved as claimed in the invention in that where the above described hermetically sealed components (24) consist of the above described cermet for a lamp.

BRIEF DESCRIPTION OF THE DRAWING

FIG. 4 shows a schematic of the results of a measurement of the electrical resistance and the average coefficient of linear expansion at 25 to 300° C. of a cermet in accordance with one embodiment of the present invention for a lamp and one example of a cermet produced for comparison purposes.

DETAILED DESCRIPTION OF THE INVENTION

The cermet in accordance with the present invention for a lamp contains a material with a coefficient of linear expansion which is greater than that of a translucent ceramic comprising the discharge vessel of the ceramic discharge lamp. Furthermore, the cermet in accordance with the present invention contains a material with a coefficient of linear expansion which is smaller than that of the translucent ceramic. Its coefficient of linear expansion is therefore essentially equal to the coefficient of linear expansion of a translucent ceramic which comprises the above described discharge vessel. It is therefore advantageous when the above described arrangements are implemented to obtain a cermet for a lamp with high efficiency.

To produce a binary ceramic for a lamp, a ceramic with a larger coefficient of linear expansion than that of the translucent ceramic (which comprises the discharge vessel of a ceramic discharge lamp) together with a metal with a smaller coefficient of linear expansion than that of the translucent ceramic is sintered. In this way, an essentially identical coefficient of linear expansion to that of the translucent ceramic which comprises the discharge vessel is obtained.

In a ternary, quaternary or higher-component cermet for a lamp, a ceramic of the same material as the translucent ceramic which comprises the discharge vessel of the ceramic discharge lamp, a metal with a coefficient of linear expansion less than that of the translucent ceramic and a material with a coefficient of linear expansion greater than that of the translucent ceramic are contained in a controlled ratio and sintered together In this way, an essentially identical coefficient of linear expansion as that of the translucent ceramic which comprises the discharge vessel is obtained.

Furthermore, in a ternary, quaternary or higher-component cermet for a lamp, a ceramic with an average coefficient of linear expansion at 25 to 300° C. which is in the range of $E \pm 1.0 \times 10^{-6}$ ($K^{-1}$) is used as the ceramic which forms the cermet when the average coefficient of linear expansion of the translucent ceramic comprising the discharge vessel (10) of the above described ceramic discharge lamp at 25 to 300° C. For this purpose, a ceramic of the same material as the translucent ceramic comprising the discharge vessel is used. In this way a cermet is easily obtained with a coefficient of linear expansion essentially equal to that of the above described translucent ceramic.

Fritting-welding of the hermetically sealed components of such cermet for a lamp in the side tube parts of the discharge vessel consisting of translucent ceramic, and formation of a hermetically sealed arrangement prevent cracks from forming in the ceramic discharge vessel during in production and in operation at the welded sites.

Figure 1:
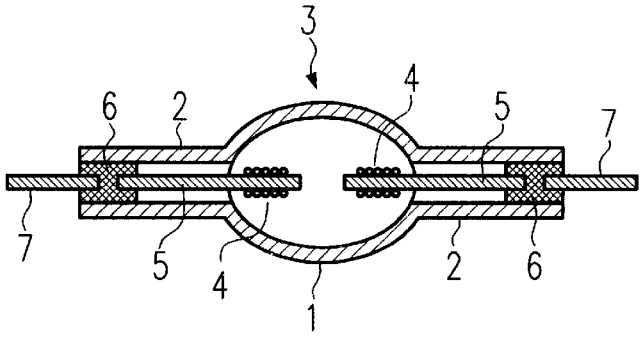
Fig. 1 (Prior Art)
FIG. 1 shows a schematic cross section of one example of a conventional ceramic discharge lamp.
Figure 2:
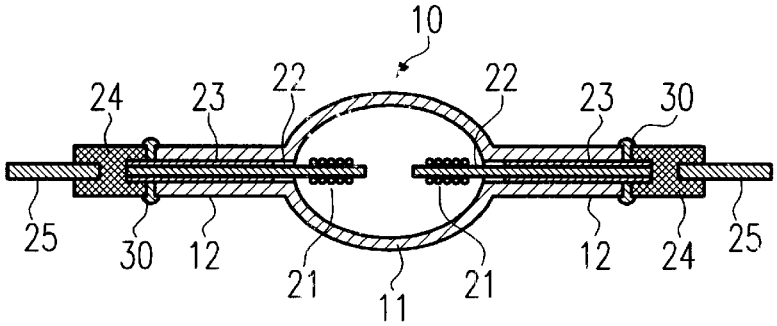
FIG. 2 shows a schematic cross section of one embodiment of a ceramic discharge lamp in according with the present invention.

FIG. 2 is a schematic cross section of one embodiment of a ceramic discharge lamp in accordance with the present invention. In this example, a discharge vessel 10 which comprises a ceramic discharge lamp has an oval arc tube part 11 and side tube parts 12 which project to the outside from the two ends of the arc tube part 11. The discharge vessel 10 consists of translucent ceramic.

The length of the discharge vessel is 28 to 40 mm, the maximum outside diameter of the arc tube part 11 is 4.0 to 10.0 mm, the inside volume is 0.05 to 0.6 $cm^3$, the outside diameter of the side tube part 12 is 1.8 to 2.6 mm and the inside diameter of the side tube part 12 is 0.3 to 1.2 mm.

Aluminum oxide polycrystal, yttrium-aluminum garnet (YAG) polycrystal, yttrium oxide polycrystal or the like can be used as the translucent ceramic comprising the discharge vessel 10. However, among them aluminum oxide polycrystal is preferred.

In this discharge vessel 10, the arc tube part 11 and the side tube parts 12 are made (produced) joined integrally to one another. The form or the production method of the discharge vessel 10 is not, however, limited thereto. For example, one end of the component for forming the side tube part can be inserted at a time into openings on the two ends of the component for forming the arc tube part and in this way a component for forming the discharge vessel can be produced, one of the ends of the components for forming the side tube parts can be hardened and attached when the component for forming the discharge vessel is sintered, and thus, the side tube parts 12 can be joined to the two ends of the arc tube part 11.

Within the arc tube part 11 of the discharge vessel 10, there are a pair of electrodes 21 opposite one another. These electrodes 21 are each produced by one tip region of the upholding part 22 of the electrode (which extends to the outside) being wound with an electrode spiral which passes from the arc tube part 11 through the side tube part 12.

There is a sleeve 23 in the upholding part 22 of the electrode in an area away from the tip area. The base part of the upholding part 22 of the electrode provided with the sleeve 23 is inserted on the side of the inner face of a cylindrical hermetically sealed component 24. On the side of the outer face of this hermetically sealed component 24, one end of an outer lead pin 25 is inserted. An electrode module is formed by the electrodes 21, the upholding parts 22 of the electrodes, the sleeves 23, the hermetically sealed components 24 and the outer lead pins 25.

In FIG. 2 reference number 30 labels frit glass which is present between the outer face of the side tube part 12 and the inner face of the hermetically sealed component 24. The component 24 to be hermetically sealed is frit-welded to the outer face of the side tube part 12 via this frit glass 30. In this way, the position of the electrode 21 is fixed and a hermetically sealed arrangement is formed. In this case, as the frit glass, glass which is based on an oxide of the rare earths —$Al_2O_3$—$SiO_2$ or the like can be used.

By means of this arrangement in which the hermetically sealed component 24 is frit-welded to the outside face of the side tube part 12, in a discharge vessel 10 with side tube parts 12 with a small diameter, (such as for example with an inside diameter of less than or equal to 0.8 mm), a hermetically sealed arrangement can be reliably formed and a discharge lamp of ceramic with a small shape can be effectively produced.

Here, the upholding parts 22 of the electrodes consist of tungsten wire with a diameter of 0.15 to 0.5 mm and the outer lead pin 25 consists of a tungsten wire, a molybdenum wire or a wire of a metal from the platinum group with a diameter from 0.2 to 0.7 mm. The electrode spiral with which the tip area of the upholding part 22 of the electrode is wound consists of a tungsten wire with a diameter of 0.06 to 0.3 mm.

The outside diameter of the sleeve 23 matches the inside diameter of the side tube part 12. It is desirable that the inside diameter of the sleeve 23 has a shape which matches the diameter of the upholding part 22 of the electrode. It is especially preferred that the difference between the outside diameter of the sleeve 23 and the inside diameter of the side tube part 12 is small. It is desirable that it is specifically less than or equal to 0.12 mm. In this way, the distance between the two becomes relatively small, and it becomes possible to keep the amount of the added material which penetrates and condenses here small.

The hermetically sealed component 24 consists of a conductive cermet with a material which has been selected according to the material of the translucent ceramic which comprises the discharge vessel 10. This means that it is necessary for the difference between the coefficient of linear expansion of the translucent ceramic which forms the discharge vessel 10 and the coefficient of linear expansion of the cermet which forms the hermetically sealed component 24 to be small. Specifically it is desirable for the difference between the average coefficient of linear expansion of the translucent ceramic which forms the discharge vessel 10 and the average coefficient of linear expansion of the cermet which forms the hermetically sealed component 24 to be up to $1.0\times10^{-6}$ ($K^{-1}$), especially up to $0.5\times10^{-6}$ ($K^{-1}$) when the "average coefficient of linear expansion at 25 to 300° C." is measured (hereinafter called only the average coefficient of linear expansion).

The measure of having the difference between the two average coefficients of linear expansion up to $1.0\times10^{-6}$ ($K^{-1}$) prevents cracks from forming at the locations at which side tube parts 12 of the discharge vessel 10 and the hermetically sealed components 24 are welded to one another. Thus a hermetically sealed arrangement can be formed with high reliability.

Here, the average coefficient of linear expansion of the translucent ceramic which forms the discharge vessel 10 is, for example, for aluminum oxide polycrystal $7.0\times10^{-6}$ ($K^{-1}$), for YAG polycrystal $7.2\times10^{-6}$ ($K^{-1}$) and for yttrium oxide polycrystal $7.8\times10^{-6}$ ($K^{31\ 1}$). The value of the coefficient of linear expansion fluctuates depending on the production method, the density, the crystal orientation and the like of the translucent ceramic. The above described average coefficients of linear expansion are therefore only examples (reference values).

The cermet (cermet comprising the hermetically sealed component 24) which meets the above described condition, specifically that the difference of the two average coefficients of linear expansion is up to $1.0\times10^{-6}$ ($K^1$), is a cermet which contains a material with a coefficient of linear expansion which is greater than that of the translucent ceramic comprising the discharge vessel (10), and which furthermore contains a material with a coefficient of linear expansion which is smaller than that of the translucent ceramic comprising the discharge vessel 10.

Specifically, a (1) binary ceramic can be used which is produced by sintering with one another a ceramic (hereinafter called "ceramic (A1)") with a larger coefficient of linear expansion than that of the translucent ceramic which comprises the discharge vessel (10) and a metal (hereinafter called "metal (B)") with a coefficient of linear expansion smaller than that of the translucent ceramic comprising the discharge vessel 10. Alternately a (2) ternary, quaternary or higher-component cermet can be used which is obtained by sintering with one another a ceramic which acts as the base material (hereinafter called "ceramic (A2)", (the metal (B) and a material (hereinafter called "material (C)") with a coefficient of linear expansion greater than that of the translucent ceramic comprising the discharge vessel 10.

In a binary cermet, the ceramic (A1) from which this cermet is formed is not especially limited if it has a coefficient of linear expansion greater than that of the translucent ceramic which comprises the discharge vessel 10. Therefore different types can be used. When the discharge vessel 10 is formed from aluminum oxide poly crystal, for example magnesium oxide (MgO) (coefficient of linear expansion: $13.\times10^{-6}$ ($K^{-1}$), zirconia ($ZrO_2$) (coefficient of linear expansion: 8.2 (1/K) or the like can be used as the ceramic (A1).

In a ternary, quaternary or higher-component cermet the same material (for example, aluminum oxide poly crystal, YAG poly crystal, or yttrium oxide poly crystal, as was described above) as the translucent ceramic comprising the discharge vessel 10, or a different material than this translucent ceramic can be used as the ceramic (A2) of which this cermet consists.

It is desirable to use a ceramic with an average coefficient of linear expansion at 25 to 300° C. which is in the range of $E\pm1.0\times10^{-6}$ ($K^{-1}$) where E ($K^{-1}$) is the average coefficient of linear expansion of the translucent ceramic comprising the discharge vessel (10) at 25 to 300° C. It is especially preferred that the ceramic which forms the cermet consists of the same material as the translucent ceramic comprising the discharge vessel 10.

By using one such ceramic (A2), a cermet can be easily obtained with a coefficient of linear expansion essentially equal to that of the above described translucent ceramic comprising the discharge vessel 10.

The ternary, quaternary or higher-component cermet contains the ceramic (A2) conventionally at a volumetric proportion in the range from 15 to 60%.

The metal (B) comprising the cermet is an essential component to yield the conductivity necessary for electrical supply. One such metal is not especially limited if its coefficient of linear expansion is smaller than that of the translucent ceramic comprising the discharge vessel 10. Different types can be used, for example metal with a high melting point such as tungsten (coefficient of linear expansion: $4.6\times10^{-6}$ ($K^{1}$)), tantalum (coefficient of linear expansion: $6.5\times10^{-6}$ ($K^{-1}$)), molybdenum coefficient of linear expansion: $4.9\times10^{-6}$ ($K^{-1}$)), rhenium (coefficient of linear expansion: $6.7\times10^{-6}$ ($K^{-1}$) ), niobium (coefficient of linear expansion: $7.3\times10^{-6}$ ($K^{1}$)), or the like.

The binary cermet contains the metal (B) conventionally in a volumetric proportion in the range from 20 to 70%.

The ternary, quaternary or high-component cermet contains the metal (B) conventionally in a volumetric proportion in the range from 20 to 70%.

In a ternary, quaternary or higher-component cermet the material (C) is a component which is used to fix the difference between the average coefficient of linear expansion of the cermet to be obtained and the average coefficient of linear expansion of the translucent ceramic comprising the discharge vessel 10 at up to $1.0\times10^{-6}$ ($K^{-1}$). The feature of the invention consists in suppressing the decrease of the coefficient of linear expansion (as a result of the presence of the metal (B)) by using the material (C).

For this material (C) a metal or a ceramic can be selected with an average coefficient of linear expansion greater than that of the translucent ceramic comprising the discharge vessel 10, such as for example platinum (coefficient of linear expansion: $8.8\times10^{-6}$ ($K^{-1}$)), rhodium (coefficient of linear expansion: $8.3\times10^{-6}$ ($K^{-1}$) ), zirconium carbide (coefficient of linear expansion: $7.2\times10^{-6}$ ($K^{-1}$)), titanium boride (coefficient of linear expansion: $7.6\times10^{-6}$ ($K^{-1}$)), dysprosium oxide (coefficient of linear expansion: $7.8\times10^{-6}$ ($K^{-1}$)), yttrium oxide (coefficient of linear expansion: $7.8\times10^{-6}$ ($K^{-1}$)), magnesium aluminate ($MgAl_2O_4$) (coefficient of linear expansion: $8.4\times10^{-6}$ ($K^{-1}$)), or the like.

The ternary, quaternary or higher-component cermet contains the material (C) conventionally in a volumetric proportion in the range from 15 to 65%.

To ensure the conductivity of the cermet to be obtained, it is necessary for a volumetric proportion of greater than or equal to 25% of the material component of this cermet to consist of a conductor. In the case in which the above described metal (B) is contained in a volumetric proportion of less than 25%, it is therefore necessary that a conductor is chosen for part or all of material (C) so that the total content of this conductor (C) and of the metal (B) is greater than or equal to 25%.

The coefficient of linear expansion of the cermet to be obtained, based on the coefficient of linear expansion of the ceramic (A1) which forms the cermet, of the ceramic (A2), of the metal (B) and of the material (C) and their mixing ratios cannot be determined by a proportional computation. To essentially bring into agreement the coefficient of linear expansion of the cermet to be obtained with the coefficient of linear expansion of the translucent ceramic which forms the discharge vessel 10, it is necessary that the ratio of use of the material components to one another (especially for a ternary, quaternary or higher-component cermet the ratio of the metal (B) to the material (C)) be changed in a suitable manner so that a cermet is produced, and based on the data of the coefficient of linear expansion measured in this regard an optimum ratio of use is determined.

Specifically for example a cermet based on MgO—Mo, a cermet based on $ZrO_2$—Mo, a cermet based on $ZrO_2$—W or the like may be used as the binary cermet.

Specifically, for example a cermet based on $Al_2O_3$—Mo—Pt, a cermet based on $Al_2O_3$—Mo—$Dy_2O_3$, a cermet based on $Al_2O_3$—Mo—$Y_2O_3$, a cermet based on ZrC—$TiB_2$, a cermet based on ZrC—SiC—Mo or the like may be used as the ternary, quaternary or higher-component cermet.

The average coefficient of linear expansion of the cermet obtained in the manner described above (of the cermet as claimed in the invention for a lamp) is in the range of $E\pm1.0\times10^{-6}$ ($K^{-1}$) where E ($K^{-1}$) the average coefficient of linear expansion of the translucent ceramic comprising the discharge vessel (10).

Forming the hermetically sealed components 24 (cermet) from one such cermet prevents cracks from forming in the production of this ceramic discharge lamp and during operation at the locations where the discharge vessel 10, the side tube parts 12 and the hermetically sealed components 24 are welded to one another.

Figure 3:
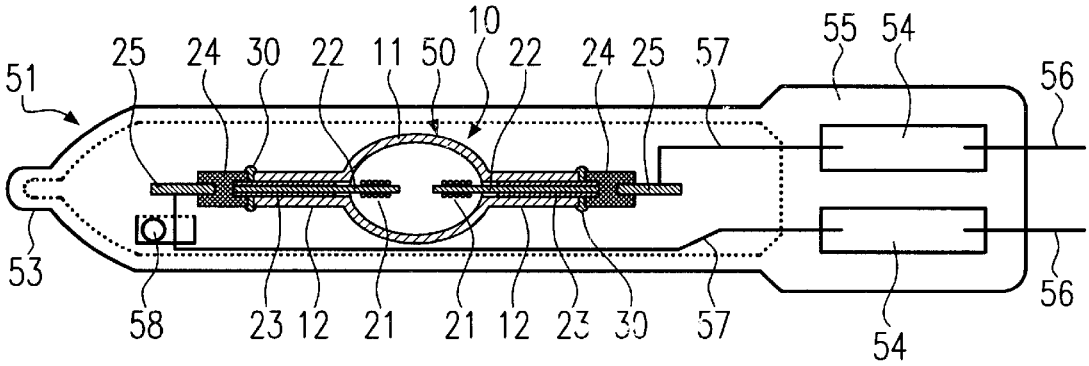
FIG. 3 shows a schematic cross section of another embodiment of a ceramic discharge lamp in according with the present invention.

FIG. 3 is a schematic cross section of the arrangement of one example of a metal halide lamp of the double tube type which has a ceramic discharge lamp in accordance with the present invention as the inside tube.

In the metal halide lamp shown in the figure there is an inside tube 50 which consists of the ceramic discharge lamp in accordance with the present invention (for example, of the discharge lamp shown in FIG. 2) positioned within an outside tube 51.

The outside tube 51 of the metal halide lamp on one end, has a residue 53 of an outlet tube and on the other end, there is a crimped foot area 55 into which a molybdenum foil 54 has been inserted. The outside tube 51 consists of fused silica glass or hard glass. The inside of the outside tube 51 is under a vacuum by evacuation.

In the figure, reference number 56 labels a feeding lead which is electrically connected via the molybdenum foil 54 and an inner lead 57 to the outer lead pin 25 of the inside tube 50 (ceramic discharge lamp in accordance with the present invention).

Reference number 58 labels a getter of Zr—Al alloy which is spot welded to a holding device which is located within the outside tube 51 (not shown in the drawing).

Embodiments of the invention are described in the following. The invention is however not limited to these embodiments.

In the following the invention is further described using several embodiments. The invention is however not limited to these embodiments.

PRODUCTION EXAMPLE 1

70 percent by volume of aluminum oxide powder with an average grain size of 2 microns (ceramic (A2)), 15 percent by volume of fine molybdenum powder with an average grain size of 0.5 micron (metal (B)), 15 percent by volume of platinum powder with an average grain size of 1 micron (material (C)) and stearic acid (binder) were mixed and subjected to compaction. In this way, a compact was produced from this mixture.

The resulting compact was heated at 400° C. for four hours in a hydrogen atmosphere. In this way the stearic acid was removed. Then heating was done for one hour at 1000° C. and temporary sintering was done. A temporarily sintered body obtained in this way was heated in a vacuum at 1700° C. for 30 minutes and thus fully sintered. In this way, a compact of the cermet in accordance with one example of the present invention (cermet based on $Al_2O_3$—Mo—Pt) was produced (cylinder with a diameter of 1.8 mm and a length of 5 mm).

PRODUCTION EXAMPLE 2

20 percent by volume of aluminum oxide powder with an average grain size of 2 microns (ceramic (A2)), 40 percent by volume of fine molybdenum powder with an average grain size of 0.5 micron (metal (B)), 40 percent by volume of dysprosium oxide powder with an average grain size of 0.5 micron (material (C)) and stearic acid (binder) were mixed and subjected to compaction. In this way a compact was produced from this mixture. Then a compact (cylinder with a diameter of 1.8 mm and a length of 5 mm) was produced from a cermet in accordance with another example of the present invention (cermet based on $Al_2O_3$—Mo—$Dy_2O_3$) in the same way as in production example 1 besides the fact that the compact now obtained has been used.

PRODUCTION EXAMPLE 3

15 percent by volume of aluminum oxide powder with an average grain size of 2 microns (ceramic (A2)), 40 percent by volume of fine molybdenum powder with an average grain size of 0.5 micron (metal (B)), 45 percent by volume of yttrium oxide powder with an average grain size of 2 microns (material (C)) and stearic acid (binder) were mixed and subjected to compaction. In this way a compact was produced from this mixture. Then a compact (cylinder with a diameter of 1.8 mm and a length of 5 mm) was produced from a cermet in accordance with another example of the present invention (cermet based on $Al_2O_3$—Mo—$Y_2O_3$) in the same way as in production example 1, besides the fact that the compact obtained has been used.

PRODUCTION EXAMPLE 4

20 percent by volume of magnesium oxide powder with an average grain size of 2 microns (ceramic (A1)), 80 percent by volume of fine molybdenum powder with an average grain size of 0.5 micron (metal (B)), and stearic acid (binder) were mixed and subjected to compaction. In this way, a compact was produced from this mixture. Then a compact (cylinder with a diameter of 1.8 mm and a length of 5 mm) was produced from a cermet in accordance with another example of the present invention (cermet based on MgO—Mo) in the same way as in production example 1, besides the fact that the compact obtained has been used.

PRODUCTION EXAMPLE 5

75 percent by volume of zirconia powder with an average grain size of 2 microns (ceramic (A1)), 25 percent by volume of fine molybdenum powder with an average grain size of 0.5 micron (metal (B)), and stearic acid (binder) were mixed and subjected to compaction. In this way, a compact was produced from this mixture. Then a compact (cylinder with a diameter of 1.8 mm and a length of 5 mm) was produced from a cermet in accordance with another example of the present invention (cermet based on $ZrO_2$—Mo) in the same way as in production example 1, besides the fact that the compact obtained has been used.

Comparison Production Example 60 percent by volume of aluminum oxide powder with an average grain size of 2 microns, 40 percent by volume of fine molybdenum powder with an average grain size of 0.5 micron and stearic acid (binder) were mixed and subjected to compaction. In this way, a compact was produced from this mixture. Then a compact (cylinder with a diameter of 1.8 mm and a length of 5 mm) was produced from a cermet for comparison purposes (cermet based on $Al_2O_3$—Mo) in the same way as in production example 1, besides the fact that the compact obtained has been used.

In the respective cermet compacts obtained in the above described manner, the electrical resistance was measured using the tetrode method and the average coefficient of linear expansion was measured at 25 to 300° C. using a measurement device for a coefficient of linear expansion. FIG. 4 shows the result.

(Embodiment 1)

Under the above described conditions, a metal halide lamp of the alternating current type (rated output: 20 W) with the arrangement which is shown in FIG. 2 was produced.

A discharge vessel (10) was produced from poly crystalline aluminum oxide (average grain size: roughly 30 microns, average coefficient of linear expansion: $6.8\times10^{-6}$/K) with a total length of 30 mm, a maximum outside diameter of the arc tube part (11) of 5.8 mm, a thickness of the arc tube part (11) of 0.5 mm, an inside volume of the arc tube part (11) of roughly 0.1 $cm^3$, an inside diameter of the side tube part (12) of 0.75 mm and an outside diameter of the side tube part (12) of 1.8 mm.

The base parts of the upholding parts (22) of the electrodes which are provided with sleeves (23) were inserted on the sides of the inner face of the hermetically sealed components (24) and the ends of an outer lead pins (25) were inserted on the sides of the outer face of the hermetically sealed components (24). This yielded an electrode module composed of the electrodes (21), the upholding parts (22) of the electrodes, the sleeves (23), the hermetically sealed components (24) and the outer lead pins 25.

Here upholding parts (22) of the electrodes of a tungsten wire with a diameter of 0.2 mm and a length of 13 mm were used.

The electrode spiral comprising the electrode 21 was formed by winding tungsten wire with a diameter of 0.08 mm (there were six turns).

Sleeves (23) of poly crystalline aluminum oxide with an outside diameter of 0.72 mm, an inside diameter of 0.23 mm and a length of 5 mm were used. A compact (with a diameter of 1.8 mm and a length of 5 mm) from the cermet ($Al_2O_3$—Mo—Pt) which was obtained in the production example 1 was used for the hermetically sealed component (24).

Outer lead pins (25) of tungsten wire with a diameter of 0.3 mm were used.

The arc tube part (11) was filled with 2.5 mg mercury, 3.2 mg of iodide bound to dysprosium-thallium-sodium ($DyI_3$—TlI—NaI) with a weight ratio of 33:10:57 and argon gas with a filling pressure of 13 kPa. The outer faces of the side tube parts (12) and the inner faces of the hermetically sealed components (24) were adjoined to one another via a frit ring (based on $Dy_2O_3$—$Al_2O_3$—$SiO_2$, average coefficient of linear expansion: $7.0\times10^{-6}$/K, inside diameter: 0.8 mm, outside diameter: 2.0 mm, thickness: 1 mm). In this way, there was an electrode module provided in the discharge vessel (10) (distance between the electrodes: 3.0 mm). Next, the frit ring was heated to 1700° C. and thus subjected to frit-welding. Thus, a hermetically sealed arrangement was formed and the discharge lamp in accordance with one embodiment of the present invention was produced.

In the discharge lamp obtained in accordance with the present invention as described above the locations where the side tube parts (12) of the discharge vessel (10) are welded to the hermetically sealed components (24) were observed. No cracks could be detected. Even after 1000 hours of being turned on and off, no cracks could be detected at these locations.

(Embodiment 2)

Besides the fact that the compact of the cermet ($Al_2O_3$—Mo—$Dy_2O_3$) which was obtained in production examples 2 was used as the hermetically sealed component (24), a discharge lamp in accordance with another embodiment of the present invention was produced in the same way as in embodiment 1.

In the discharge lamp which was obtained in this way, the locations where the side tube parts (12) of the discharge vessel (10) are welded to the hermetically sealed components (24) were observed. No cracks could be detected. Furthermore, even after being turned on and off for one thousand hours, no cracks could be detected at these locations.

(Embodiment 3)

Besides the fact that the compact of the cermet ($Al_2O_3$—Mo—$Y_2O_3$) which was obtained in production example 3 was used as the hermetically sealed component (24), a discharge lamp in accordance with another embodiment of the present invention was produced in the same way as in embodiment 1.

In the discharge lamp which was obtained in this way, the locations where the side tube parts (12) of the discharge vessel (10) are welded to the hermetically sealed components (24) were observed. No cracks could be detected. Furthermore, even after being turned on and off for 1000 hours no cracks could be detected at these locations.

(Embodiment 4)

Besides the fact that the compact of the cermet (MgO—Mo) which was obtained in production example 4 was used as the hermetically sealed component (24), a discharge lamp in accordance with another embodiment of the present invention was produced in the same way as in embodiment 1.

In the discharge lamp which was obtained in this way, the locations where the side tube parts (12) of the discharge vessel (10) were welded to the hermetically sealed components (24) were observed. No cracks could be detected. Furthermore, even after being turned on and off for 1000 hours, no cracks could be detected at these locations.

(Embodiment 5)

Besides the fact that the compact of the cermet ($ZrO_2$—Mo) which was obtained in production example 5 was used as the hermetically sealed component (24), a discharge lamp in accordance with another embodiment of the present invention was produced in the same way as in embodiment 1.

In the discharge lamp which was obtained in this way, the locations where the side tube parts (12) of the discharge vessel (10) are welded to the hermetically sealed components (24) were observed. No cracks could be detected. Furthermore, even after being turned on and off for 1000 hours, no cracks could be detected at these locations.

Comparison Example 1

Besides the fact that the compact of the cermet based on ($Al_2O_3$—Mo) which was obtained in the comparison production example was used as the hermetically sealed component, a discharge lamp was produced in the same way as in the first embodiment 1 for comparison purposes.

The welded sites were observed in the discharge lamp obtained in this way. Cracks could be detected at the welded sites.

As was described above, the cermet in accordance with the present invention for a lamp contains a material with a coefficient of linear expansion greater than that of a translucent ceramic comprising the discharge vessel of a ceramic discharge lamp. Furthermore, the cermet in accordance with the present invention contains a material with a coefficient of linear expansion smaller than that of this translucent ceramic. Its coefficient of linear expansion is therefore, essentially the same as the coefficient of linear expansion of the translucent ceramic comprising the discharge vessel of the ceramic discharge lamp.

Fritting-welding of the hermetically sealed components of the cermet in accordance with the present invention for a lamp to the side tube parts of the discharge vessel and prevents cracks caused by different coefficients of thermal expansion from forming at the welded sites. The ceramic discharge vessel in accordance with the present invention therefore, prevents cracks from forming in production and operation at the locations at which side tube parts of the discharge vessel and the hermetically sealed components are frit-welded to one another.

What we claim is:

1. Cermet for hermetically sealing a discharge vessel in a ceramic discharge lamp, said discharge vessel comprising a translucent ceramic and said cermet comprising:

a material having a coefficient of linear expansion which is at least equal to a coefficient of linear expansion of said translucent ceramic; and a material having a coefficient of linear expansion which is smaller than the coefficient of linear expansion of said translucent ceramic;

wherein said cermet has an average coefficient of linear expansion in a range of $E \pm 1.0 \times 10^{-6}$ ($K^{-1}$) at a temperature range of 25 to 300° C., where E ($K^{-1}$) is an average coefficient of linear expansion of said translucent ceramic at a temperature range of 25 to 300° C.

2. Cermet for hermetically sealing a discharge vessel in a ceramic discharge lamp, wherein said cermet is formed by sintering together a ceramic with a coefficient of linear expansion greater than a coefficient of linear expansion of a translucent ceramic which comprises said discharge vessel, and a metal with a coefficient of linear expansion less than the coefficient of expansion of said translucent ceramic.

3. Cermet for hermetically sealing a discharge vessel in a ceramic discharge lamp, wherein said cermet is formed by sintering together a ceramic, a metal with a coefficient of linear expansion less than a coefficient of linear expansion of a translucent ceramic which comprises said discharge vessel, and a material with a coefficient of linear expansion greater than the coefficient of expansion of said translucent ceramic.

4. Cermet of claim 3, wherein said ceramic which forms said cermet has an average coefficient of linear expansion in a range of $E \pm 1.0 \times 10^{-6}$ ($K^{-1}$) at a temperature range of 25 to 300° C., where E ($K^{-1}$) is an average coefficient of linear expansion of said translucent ceramic at a temperature range of 25 to 300° C.

5. Cermet of claim 3, wherein said ceramic for forming said cermet consists of the same material as said translucent ceramic.

6. Ceramic discharge lamp comprising:

a discharge vessel of translucent ceramic, said discharge vessel including an arc tube part and side tube parts which are connected to said arc tube part; and a pair of electrodes positioned opposite to one another in said arc tube part, said pair of electrodes being hermetically sealed in said arc tube part by hermetically sealed components that are frit-welded on said side tube parts, said pair of electrodes having upholding parts with bases that are inserted into said hermetically sealed components;

wherein said hermetically sealed components comprises a cermet that includes:

a material having a coefficient of linear expansion which is at least equal to a coefficient of linear expansion of said translucent ceramic; and a material having a coefficient of linear expansion which is smaller than the coefficient of linear expansion of said translucent ceramic;

wherein said cermet has an average coefficient of linear expansion in a range of $E \pm 1.0 \times 10^{-6}$ ($K^{-1}$) at a temperature range of 25 to 300° C., where E ($K^{-1}$) is an average coefficient of linear expansion of said translucent ceramic at a temperature range of 25 to 300° C.

7. Ceramic discharge lamp of claim 6, wherein said hermetically sealed components are frit-welded on an outside face of said side tube parts, and said hermetically sealed components have at least one of a cylindrical shape and a disk shape.

* * * * *